US007285078B1

(12) United States Patent
Liu

(10) Patent No.: US 7,285,078 B1
(45) Date of Patent: Oct. 23, 2007

(54) ADJUSTABLE DUMBBELL

(76) Inventor: Ping Liu, Suite 1608, Tower A, Vanke City Garden, Zhengyi Road, Tianjin 300150 (CN)

( * ) Notice: Subject to any disclaimer, the term of this patent is extended or adjusted under 35 U.S.C. 154(b) by 0 days.

(21) Appl. No.: 11/494,248

(22) Filed: Jul. 27, 2006

(30) Foreign Application Priority Data

Mar. 24, 2006 (CN) ..... 2006 2 2025625 U
May 29, 2006 (EP) ..... 06252637

(51) Int. Cl.
*A63B 21/072* (2006.01)
*A63B 21/075* (2006.01)

(52) U.S. Cl. ..... 482/108; 482/106; 482/908

(58) Field of Classification Search ..... 482/106–109, 482/908; D21/680–682
See application file for complete search history.

(56) References Cited

U.S. PATENT DOCUMENTS 6,974,405 B2 * 12/2005 Krull ..... 482/107
7,121,988 B2 * 10/2006 Walkerdine ..... 482/106
7,137,931 B2 * 11/2006 Liu ..... 482/107
7,137,932 B2 * 11/2006 Doudiet ..... 482/107
7,172,536 B2 * 2/2007 Liu ..... 482/108
2004/0005968 A1 * 1/2004 Crawford et al. ..... 482/106
2004/0005969 A1 * 1/2004 Chen ..... 482/107

* cited by examiner

*Primary Examiner*—Lori Amerson
*Assistant Examiner*—Allana Lewin
(74) *Attorney, Agent, or Firm*—Edward P. Dutkiewicz

(57) ABSTRACT

Each of a plurality of weights has a central hole and a slot extending through the central hole. A shaft has a grip handle. A rotatable spindle extends through the grip handle with a plurality of cam plates adjacent to each end of the spindle and an adjustment knob at each end of the spindle. The cam plates each have an outer diameter adapted to fit the central hole of a weight. The weights include a set of weights positioned adjacent to each end of the rotatable spindle and adjacent to the cam plates. A holder is cooperable with the shaft with protrusion blocks adapted to cooperate with the shaft to form a self-locking mechanism.

6 Claims, 6 Drawing Sheets

FIG 2
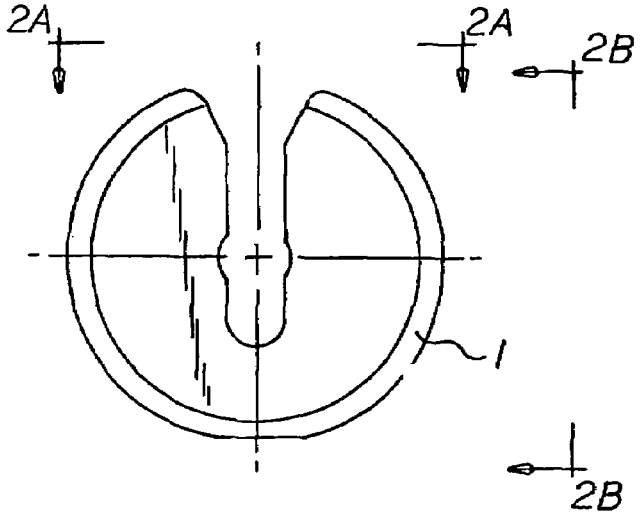
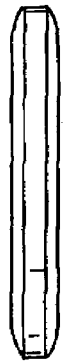
FIG 2B
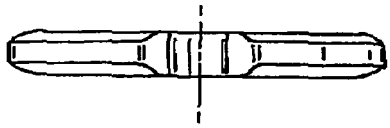
FIG 2A
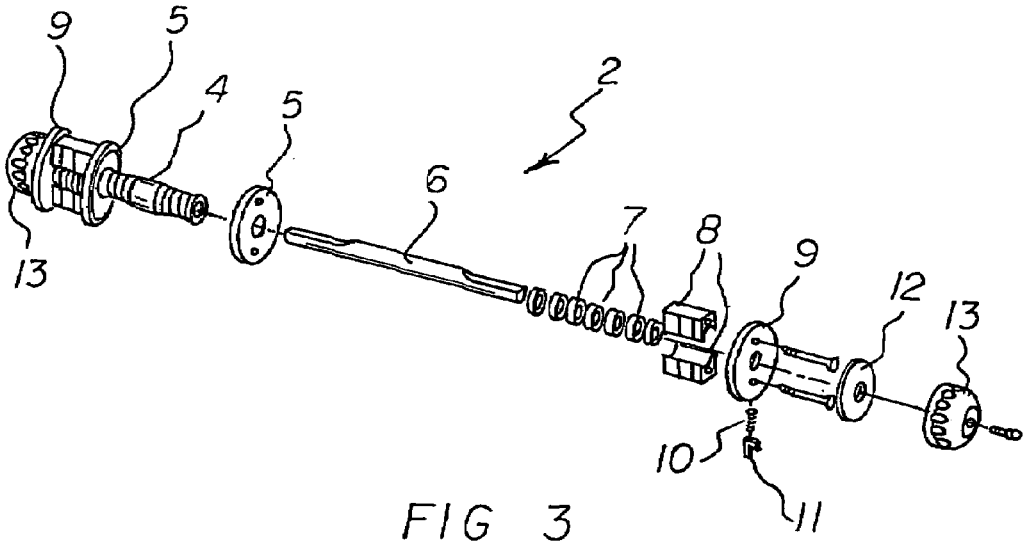
FIG 3

FIG. 4
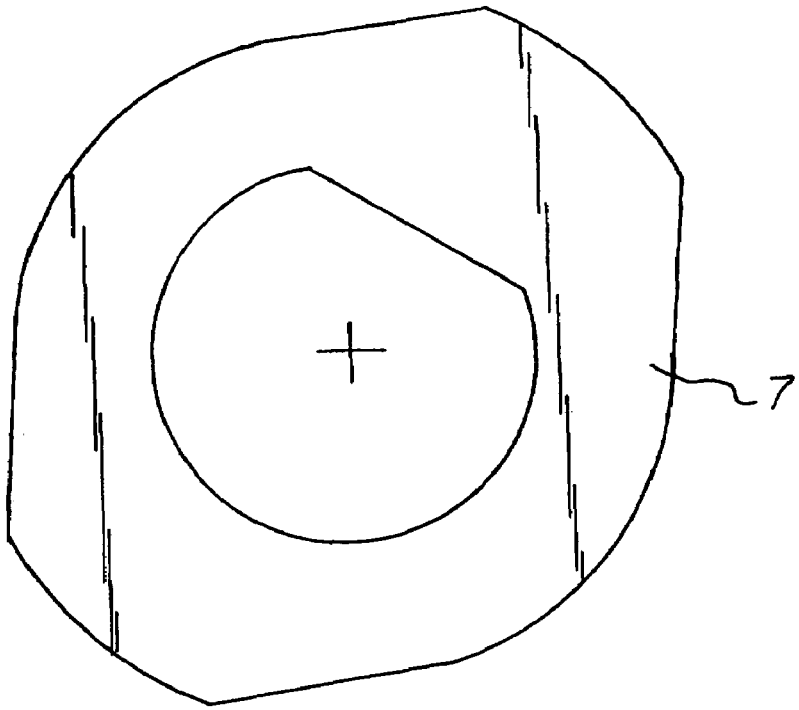
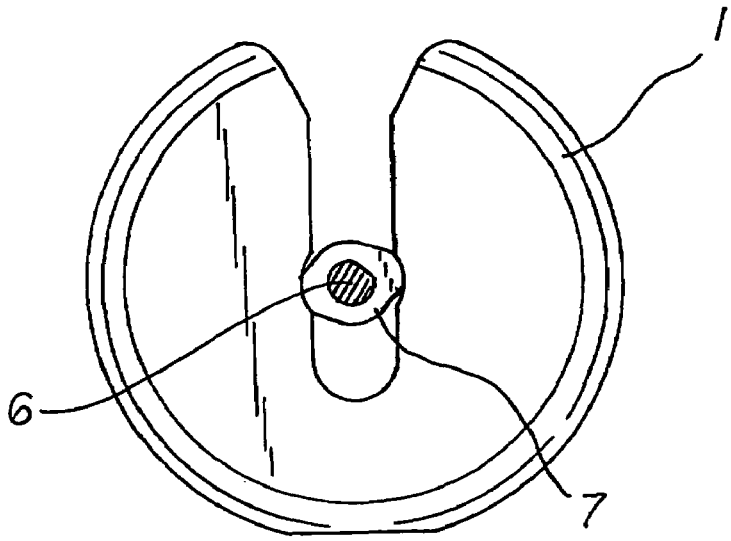
FIG. 5

ADJUSTABLE DUMBBELL

RELATED APPLICATIONS

This application claims the benefit of foreign applications filed 24 Mar. 2006 in China, Number 200620025625.4 and EPO 29 May 2006 in the EPO, Number 06252637, the subject matter of which is incorporated herein by reference.

BACKGROUND OF THE INVENTION

1. Field of the Invention

The present invention relates to exercise equipment, and particularly to an adjustable dumbbell which can be self-locked in use and adjusted for storage.

2. Description of the Prior Art

The use of dumbbells of known designs and configurations is known in the prior art. More specifically, dumbbells of known designs and configurations previously devised and utilized for the purpose of changing the weight for use are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the prior patents do not describe an adjustable dumbbell that allows self-locking for use and adjusting for storage of exercise equipment.

There are many disadvantages of commonly-used weight-lifting instruments. Weight training instruments, generally, are large in volume, expensive, and difficult to maintain, therefore, they are quite inconvenient to use. For example, they are generally complex structures composed of cables, belt pulleys, weight and other mechanisms permitting various exercise on a single machine.

Simple weight-lifting instruments generally include a shaft and many separate, removable weights. The shaft can be used by both hands or by one hand, that is, used as a dumbbell. It is desirable to minimize the possibility of weights sliding from ends of the shaft in the use of the simple weight-lifting instrument. Therefore, safety clamp mechanisms, such as clamping rings or clips, are required to fix the weight onto the shaft. However, the connection of these clamping rings or clips is troublesome, and the connection is also unsafe, especially when becoming worn or broken when, as a result, they become difficult to place in a secure position.

Assembling particular weights on a simple weight-lifting instrument is tedious. For assembling onto the shaft, a user must carry the weight from a designated storing location onto the shaft, or vice versa, and then raise up, collimate, slide and fix the weights to the shaft. Each of the weights must be placed on an individual storing location which not only increases the time for assembling the weights, but also inevitably causes the weights to be scattered around the weight-lifting area.

Although weight-lifting is considered as an anaerobic sport, because the weight lifter commonly has a break of several minutes between two sets of exercises, some individuals like to do weight-lifting as an aerobic sport. However, aerobic sports require actions which are almost continuous to maintain a high heart rate. Thus, individuals using the simple weight-lifting instrument are unable to exercise aerobically due to the requirements of withdrawing the weights and assembling and fixing them onto the shaft. The individual cannot maintain a high heart rate while spending time in repeatedly withdrawing, assembling and fixing weights.

For fixed dumbbells that do not have removable weights and clamping rings, a user has to choose lots of such dumbbells according to different weight requirements. Accordingly, these dumbbells are not convenient for use and storage.

Other dumbbells which allow adjusting the weight have no self-locking mechanism. The result is the risk of weights slipping off during use.

In this respect, the adjustable dumbbell according to the present invention substantially departs from the conventional concepts and designs of the prior art, and in doing so provides an apparatus primarily developed for the purpose of self-locking for use and adjusting for storage of exercise equipment.

Therefore, it can be appreciated that there exists a continuing need for a new and improved adjustable dumbbell which can be used for self-locking for use and adjusting for storage of exercise equipment. In this regard, the present invention substantially fulfills this need.

SUMMARY OF THE INVENTION

In view of the foregoing disadvantages inherent in the known types of dumbbells of known designs and configurations now present in the prior art, the present invention provides an improved adjustable dumbbell. As such, the general purpose of the present invention, which will be described subsequently in greater detail, is to provide an adjustable dumbbell including a self-adjusting mechanism, having the ability to provide various weight options and being self-locking during use to insure safety.

To attain this, the present invention essentially comprises an adjustable dumbbell that can be self-locked in use and adjusted for storage. First provided is a plurality of weights. Each weight has a central hole and a slot extending through the central hole and extending to both sides from the central hole. Each slot has one end passing through the central hole to a point below the central hole and another end extending upwardly to the edge of the weight to form a gap. The width of the slot is less than the diameter of the central hole.

Next provided is a weight-lifting shaft. The shaft has a grip handle and a rotatable spindle extending through the grip handle. The shaft also has, adjacent to each end of the spindle, a plurality of cam plates with an adjustment knob at each end of the spindle. The cam plates each have an outer diameter with protruding edges on opposed ends adapted to releasably couple selectively with the central hole of the weights.

The plurality of weights includes a set of weights positioned adjacent to each end of the spindle. For each set of weights and plurality of cam plates, a platform is provided on each side of each set of cam plates with a fixing plate adjacent to each adjusting knob.

Next, a spring is provided. An associated pin is adapted to be urged downwardly by the spring and is mounted to a lower portion of each platform.

Lastly provided is a holder. The holder has grooves of a size to fit the weight. The holder also has protrusion blocks. The protrusion blocks are adapted to cooperate with the pins on the platform of the shaft to form a self-locking mechanism.

An adjustable dumbbell comprises a plurality of weights, each of which has a central hole and a slat extending through the central hole, a weight-lifting shaft and a holder. The holder cooperates with the weight-lifting shaft to form a self-locking mechanism. The weight-lifting shaft comprises a grip handle, a rotatable spindle extending through the grip handle, several cam plates assembled through both ends of the rotatable spindle, and adjustment knobs assembled on both sides of the weight-lifting shaft. The outer diameters of the cam plates fit the central hole of the weights. The holder comprises grooves and protrusion blocks. The protrusion blocks cooperate with the pins on the weight-lifting shaft to form a self-locking means.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable dumbbell which has all of the advantages of the prior art dumbbells of known designs and configurations and none of the disadvantages.

It is another object of the present invention to provide a new and improved adjustable dumbbell which may be easily and efficiently manufactured and marketed.

It is further object of the present invention to provide a new and improved adjustable dumbbell which is of durable and reliable constructions.

An even further object of the present invention is to provide a new and improved adjustable dumbbell which is susceptible of a low cost of manufacture with regard to both materials and labor, and which accordingly is then susceptible of low prices of sale to the consuming public, thereby making such adjustable dumbbell economically available to the buying public.

Even still another object of the present invention is to provide an adjustable dumbbell for self-locking for use and adjusting for storage of exercise equipment.

It is a further object of the present invention to provide a new and improved exercise equipment having a plurality of weights, each with a central hole and a slot extending through the central hole. A shaft has a grip handle. A rotatable spindle extends through the grip handle with a plurality of cam plates adjacent to each end of the spindle and an adjustment knob at each end of the spindle. The cam plates each have an outer diameter adapted to fit the central hole of a weight. The weights include a set of weights positioned adjacent to each end of the rotatable spindle and adjacent to the cam plates. A holder is cooperable with the shaft with protrusion blocks adapted to cooperate with the shaft to form a self-locking mechanism.

The present invention has the advantages of having a self-adjusting mechanism, providing various weight options simultaneously, and being self-locking during use to insure safety. It is small in volume, safe and reliable for usage and storage and it is easy to assemble.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a schematic illustration of a weight, wherein FIG. 2*a* is a side view of the weight and FIG. 2*b* is a top view of the weight.

FIG. 3 is a schematic illustration of a weight-lifting shaft.

FIG. 4 is a schematic illustration of a cam plate.

FIG. 5 is a schematic view illustrating how the cam plate engages with the weights.

The same reference numerals refer to the same parts throughout the various Figures.

DESCRIPTION OF THE PREFERRED EMBODIMENT

Figure 1:
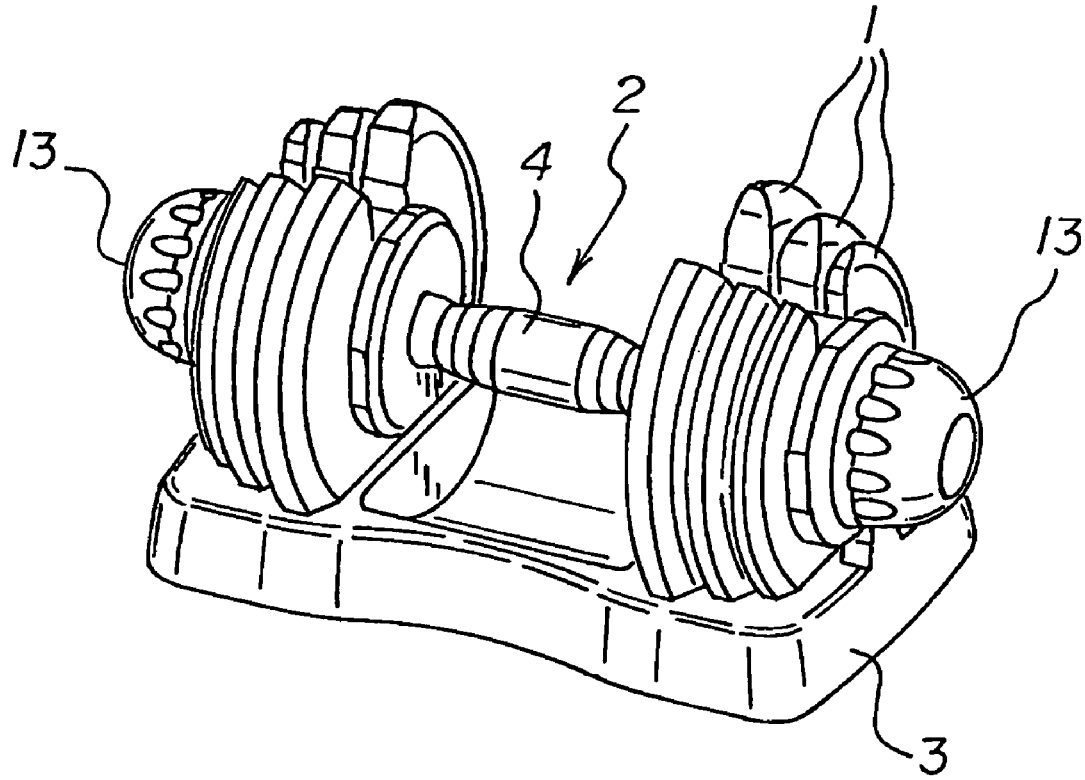
FIG. 1 is a perspective view schematically illustrating an embodiment of the present invention.

With reference now to the drawings, and in particular to FIG. 1 thereof, the preferred embodiment of the new and improved adjustable dumbbell embodying the principles and concepts of the present invention and generally designated by the reference numeral 10 will be described.

The present invention, the adjustable dumbbell 10 is comprised of a plurality of components. Such components in their broadest context include a plurality of weights including a set of weights, a shaft, and a holder. Such components are individually configured and correlated with respect to each other so as to attain the desired objective.

The adjustable dumbbell can be self-locked in use and adjusted for storage. Note FIG. 1. First provided is a plurality of weights 1. Note FIGS. 2, 5, 7 and 8. Each weight has a central hole and a slot extending through the central hole and extending to both sides from the central hole. Each slot has one end passing through the central hole to a point below the central hole and another end extending upwardly to the edge of the weight to form a gap. The width of the slot is less than the diameter of the central hole.

Next provided is a weight-lifting shaft 2. Note FIGS. 1 and 2. The shaft has a grip handle 4 and a rotatable spindle 6 extending through the grip handle. The shaft also has, adjacent to each end of the spindle, a plurality of cam plates 7 with an adjustment knob 13 at each end of the spindle. The cam plates each have an outer diameter with protruding edges on opposed ends adapted to releasably couple selectively with the central hole of the weights. Note FIGS. 4 and 5.

The plurality of weights includes a set of weights positioned adjacent to each end of the spindle. For each set of weights and plurality of cam plates, a platform 5, 9 is provided on each side of each set of cam plates with a fixing plate 12 adjacent to each adjusting knob. Note FIG. 3.

Next, a spring 10 is provided. An associated pin 11 is adapted to be urged downwardly by the spring and is mounted to a lower portion of each platform. Note FIGS. 3, 7 and 8.

Lastly provided is a holder 3. The holder has grooves 14 of a size to fit the weight. The holder also has protrusion blocks 15. The protrusion blocks are adapted to cooperate with the pins on the platform of the shaft to form a self-locking mechanism.

Platforms 5, 9 are rotatably positioned on the spindle 6 adjacent to each end of the spindle. Blocks 8 are secured to exterior platform 9 and extend into the slots of the weights 1, one block above the spindle and one block below. In this manner, gravity will continuously urge all of the weights into an orientation with their slots vertically aligned and with their gaps there above. Concurrently, the platforms and their blocks will act to abate rotational movement of the weights. The grip handle, however, is free to rotate with respect to the spindle and weights. Such abatement of weight rotation occurs when the shaft and weights are raised from the holder during lifting with the pin lowered for locking. Such abatement of weight rotation also occurs when the shaft and weights are lowered onto the holder during rest or adjustment with the pin raised for unlocking. When the shaft and weights are lowered onto the holder and the pin unlocked, the adjustment knobs are adapted to be rotated by a user to rotate the spindle for selectively bringing an appropriate cam into operative coupling association with an associated weight.

By way of further explanation, an adjustable dumbbell as shown in FIG. 1 comprises a plurality of weights 1, a weight-lifting shaft 2, and a holder 3. The holder is coupled to the weight-lifting shaft to form a self-locking mechanism.

Each of the weights has a central hole and a slot extending through the central hole as shown in FIG. 2. The slot extends from the central hole to the two sides, with one end (upper end) of the slot passing through the central hole and reaching a point between the central hole and the edge of the weight, and the other end (lower end) of the slot extending to the edge of the weight to form a gap therein. The width of the slot is less than the diameter of the central hole, and its outline can be designed to show various appearances as users prefer.

FIG. 3 shows the weight-lifting shaft comprising a grip handle 4, a rotatable spindle 6 extending through the grip handle, several cam plates 7 assembled through both ends of the rotatable spindle, platforms 5 and 9 assembled onto the two sides of the cam plate respectively, a fixing plate 12, and adjustable knobs 13 assembled on both ends of the weight-lifting shaft. Pins 11, which can be pushed out by springs 10, are mounted to the lower portion of the platform 9. Before contact with the holder 3, the pins 11 are pushed out by the springs 10 to form a self-locking mechanism, that is, the pins will be locked on to the fixing plate, so as to lock the knob 13. With contact with the holder, pins 11 will be separated from the fixing plate 12 by the springs 10, and then the knob could rotate freely.

Figure 6:
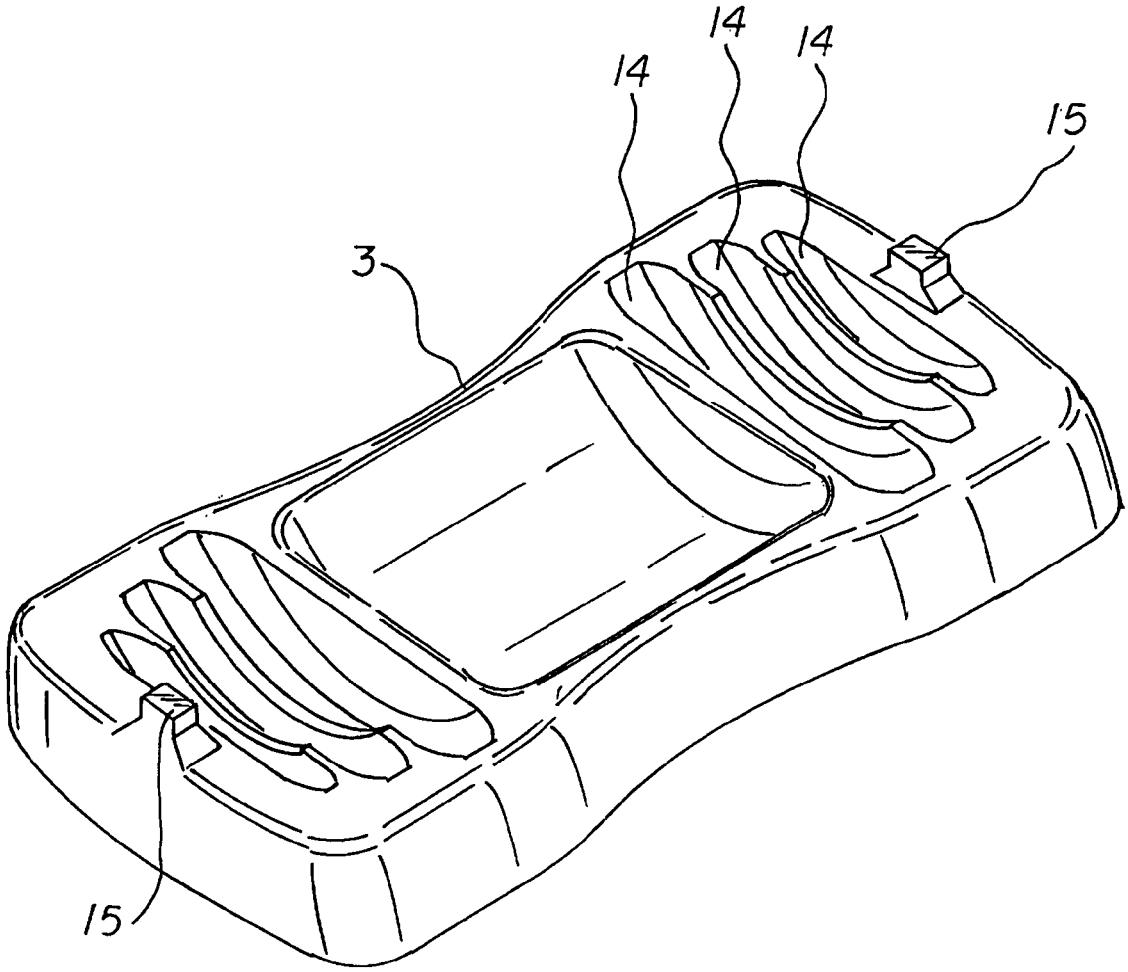
FIG. 6 is a view schematically illustrating the holder of the dumbbell.
Figure 7:
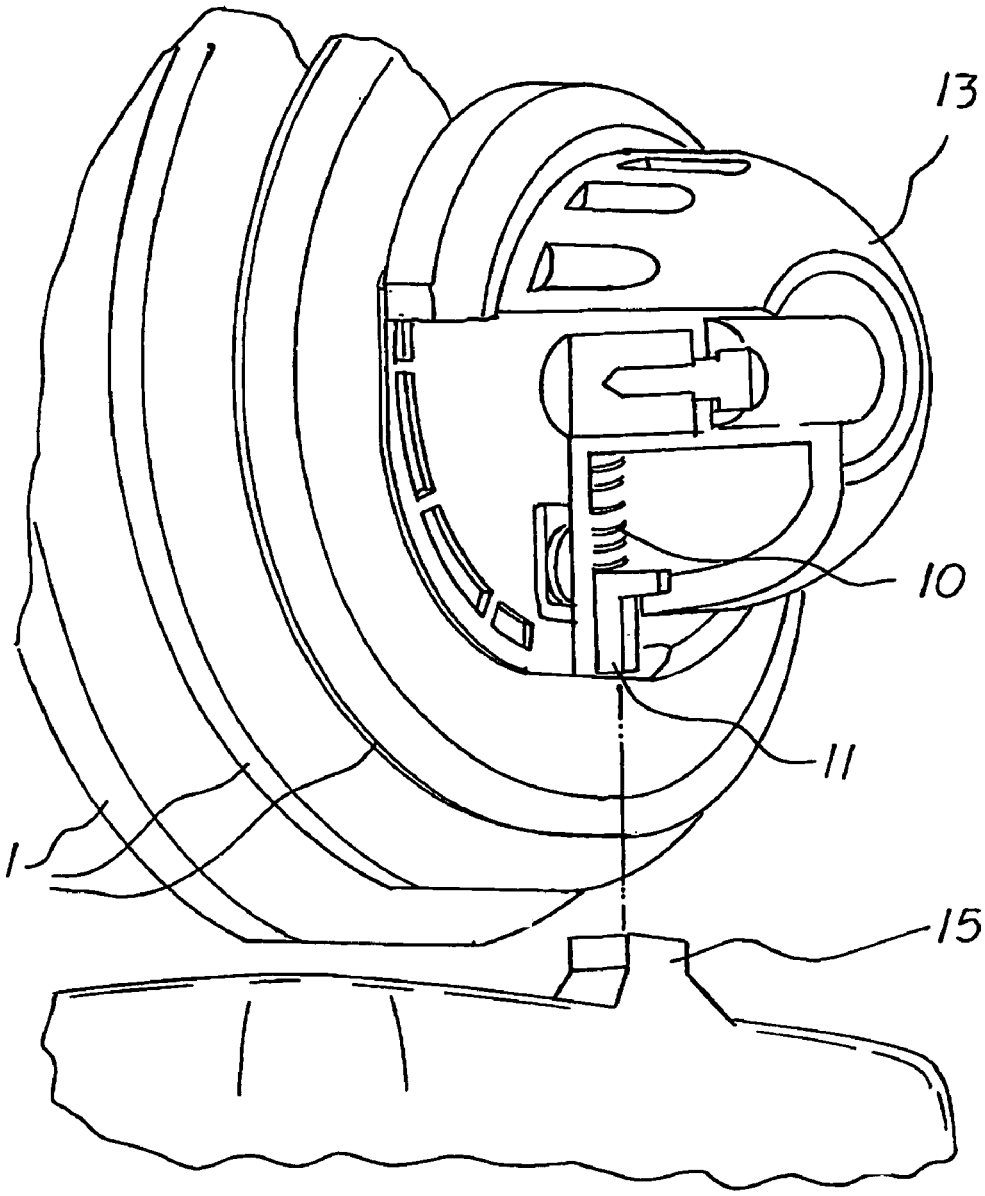
FIG. 7 is a schematic illustration of the structure of the self-locking mechanism.

FIGS. 6 and 7 show the grooves 14 and protrusion blocks 15 in the holder. The grooves 14 may fit the corresponding weights. The protrusion blocks 15 may cooperate with the pin on the weight-lifting shaft to form a self-lock. The appearance of the holder can be designed as a user prefers. The holder is used to clamp pairs of weights firmly when the knob is rotated, and store the weights steadily when the dumbbell is lifted.

Figure 8:
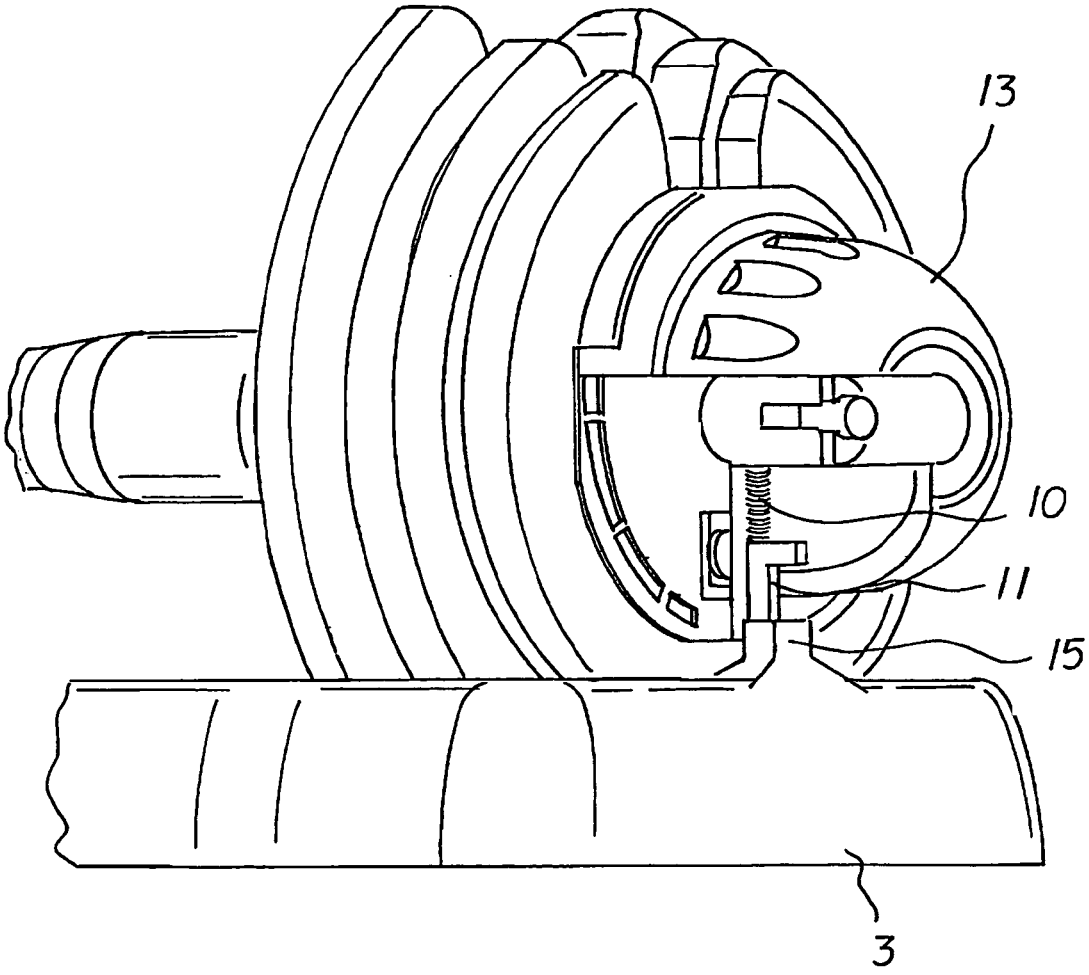
FIG. 8 is a perspective view further illustrating the structure of the self-locking mechanism.

As shown in FIG. 8, after the protrusion blocks 15 on the holder contact the pins 11 on the weight-lifting shaft, different weights can be chosen by rotating the knobs 13 and cooperating with the central hole in the weights 1. Further, the knobs on both the left and right sides can be rotated to choose the same weights simultaneously. If the user holds up the dumbbell, then the pins 11 and the protrusion blocks 15 are separated, and the knob 13 is self-locked without rotation. In this way, the user is able to use the dumbbell at will, with the weights attached to the cam plates 7 safely and reliably.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable dumbbell comprising:

a plurality of weights, each of which has an edge and a central hole and a slot extending through the central hole;

a weight-lifting shaft; and a holder;

wherein:

the holder cooperates with the weight-lifting shaft to form a self-locking mechanism;

the weight-lifting shaft comprises a grip handle, a rotatable spindle extending through the grip handle, several cam plates assembled through both ends of the rotatable spindle, and adjustment knobs assembled on both sides of the weight-lifting shaft; the outer diameters of the cam plates fit the central hole of the weights; and the holder comprises grooves and protrusion blocks; the grooves fit the weights and the protrusion blocks cooperate with the pins on the weight-lifting shaft to form a self-locking means.

2. The adjustable dumbbell as defined in claim 1 wherein the slot extends downwardly to a point below the central hole upwardly to the edge of the weight to form a gap.

3. The adjustable dumbbell as defined in claim 1 wherein:

platforms and fixing plates are provided on both sides of the several cam plates of the weight-lifting shaft; protruding edges are provided on opposed ends of the cam plates; the outer diameters of the cam plates are configured to fit the central hole of the weights;

pins pushed by springs are mounted to the lower portion of the platform on one side;

protrusion blocks are provided in the holder, the protrusion blocks cooperate with pins on the weight-lifting shaft to form a self-locking mechanism.

4. The adjustable dumbbell as defined in claim 1 wherein:

the width of the slot extending through the central hole is less than the diameter of the central hole.

5. Adjustable exercise equipment comprising:

a plurality of weights each having a central hole and a slot extending through the central hole;

a shaft having a grip handle and a rotatable spindle extending through the grip handle with a plurality of cam plates adjacent to each end of the spindle and an adjustment knob at each end of the spindle, the cam plates each having an outer diameter adapted to fit the central hole of a weight;

the plurality of weights including a set of weights positioned adjacent to each end of the rotatable spindle and adjacent to the cam plates; and a holder with protrusion blocks adapted to cooperate with the shaft to form a self-locking mechanism.

6. An adjustable dumbbell which can be self-locked in use and adjusted for storage comprising:

a plurality of weights, each weight having a central hole and a slot extending through the central hole, each slot having one end passing through the central hole to a point below the central hole and another end extending upwardly to the edge of the weight to form a gap, the width of the slot being less than the diameter of the central hole;

a weight-lifting shaft having a grip handle and a rotatable spindle extending through the grip handle and, adjacent to each end of the spindle, a plurality of cam plates with an adjustment knob at each end of the spindle, the cam plates each having an outer diameter with protruding edges on opposed ends adapted to releasably couple selectively with the central hole of the weights;

the plurality of weights including a set of weights positioned adjacent to each end of the spindle and, for each set of weights and plurality of cam plates, a platform on each side of each set of cam plates with a fixing plate adjacent to each adjusting knob;

a spring with an associated pin adapted to be urged downwardly by the spring mounted to a lower portion of each platform; and a holder having grooves of a size to fit the weights, the holder also having protrusion blocks adapted to cooperate with the pins on the platform of the shaft to form a self-locking mechanism.

* * * * *